US010259233B2

(12) United States Patent
Rietbergen et al.

(10) Patent No.: US 10,259,233 B2
(45) Date of Patent: Apr. 16, 2019

(54) INK HANDLING SYSTEM FOR AN INK JET PRINTER

(71) Applicant: Océ Holding B.V., Venlo (NL)

(72) Inventors: Mark Rietbergen, Venlo (NL); Antonius G. Van Rooijen, Venlo (NL); Benjamin P. H. Van Rens, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/834,871

(22) Filed: Dec. 7, 2017

(65) Prior Publication Data

US 2018/0162136 A1 Jun. 14, 2018

(30) Foreign Application Priority Data

Dec. 14, 2016 (EP) ..... 16204115

(51) Int. Cl.
*B41J 2/175* (2006.01)

(52) U.S. Cl.
CPC ..... *B41J 2/17566* (2013.01); *B41J 2/175* (2013.01); *B41J 2/1752* (2013.01); *B41J 2/17596* (2013.01); *B41J 2002/17569* (2013.01)

(58) Field of Classification Search
CPC ..... B41J 2/175; B41J 2/17566; B41J 2/1752; B41J 2/17596; B41J 2002/17569
See application file for complete search history.

(56) References Cited

U.S. PATENT DOCUMENTS

| | | | |
|---|---|---|---|
| 6,155,664 | A | 12/2000 | Cook |
| 7,717,540 | B1 | 5/2010 | King et al. |
| 2002/0167572 | A1 | 11/2002 | Heim et al. |
| 2015/0375516 | A1 | 12/2015 | Nicholson, III et al. |

FOREIGN PATENT DOCUMENTS

| | | |
|---|---|---|
| WO | WO 2016/066208 A1 | 5/2016 |
| WO | WO 2016/076884 A1 | 5/2016 |

OTHER PUBLICATIONS

Search Report for European Patent Application No. 16204115, completed on May 10, 2017.

*Primary Examiner* — Lamson D Nguyen
(74) *Attorney, Agent, or Firm* — Birch, Stewart, Kolasch & Birch, LLP

(57) ABSTRACT

An ink handling system for an ink jet printer includes a local ink reservoir associated with a print head assembly of the printer, a fill state sensor arranged to detect a fill state of the local ink reservoir, a pump arranged to supply ink into the local ink reservoir, and a pump controller for controlling an operation of the pump, including controlling an on/off state of the pump, on the basis of a detection result of the fill state sensor. A pump calibration system includes an ink consumption measurement system including a droplet counter for counting a number of ink droplets jetted out by the print head assembly and arranged to calculate a volume V of consumed ink on the basis of the counted number of droplets; a timer for counting an on-time T of the pump; a flow rate calculator arranged to calculate an measured ink flow rate of the pump on the basis of the ratio V/T; and a flow rate drift compensation functionality in the pump controller, the compensation functionality being configured to control the operation of the pump on the basis of the measured ink flow rate.

7 Claims, 4 Drawing Sheets

INK HANDLING SYSTEM FOR AN INK JET PRINTER

The invention relates to an ink handling system for an ink jet printer, the system comprising a local ink reservoir associated with a print head assembly of the printer, a fill state sensor arranged to detect a fill state of the local ink reservoir, a pump arranged to supply ink into the local ink reservoir, and a pump controller for controlling an operation of the pump, including controlling an on/off state of the pump, on the basis of a detection result of the fill state sensor.

An example of an ink handling system of this type has been disclosed in US 2015/375516 A1.

An ink jet printer typically has a plurality of print heads each of which is associated with a local ink reservoir containing a small amount of ink that can readily be supplied to the associated print head. Optionally, a local ink reservoir may serve a print head assembly that comprises two or more print heads.

When the fill state detector detects that the level of ink in the local ink reservoir has decreased below a certain threshold, the pump controller will activate the pump for a certain time in order to refill the ink reservoir.

Depending upon the design of the printer, it is frequently desired that the flow rate with which the pump supplies fresh ink to the ink reservoir is held stably within narrow tolerance limits. For example, if the print head is of a type operating above room temperature, e.g. a print head for printing a UV curable inkjet ink at elevated temperature, then the ink supplied to the ink reservoir passes through a heater where the ink is heated to the operating temperature. In that case, the maximum flow rate of the pump is limited by the heating capacity of the heater. On the other hand, the minimum flow rate of the pump must always be large enough to replace the ink that has been consumed by jetting out ink droplets from the print head.

In practice, however, the displacement of the pump and hence the flow rate with which the ink is supplied to the ink reservoir may be subject to a drift that may result for example from ageing effects.

A particularly attractive type of pump to be used in an ink handling system is a peristaltic pump wherein the ink is contained in a flexible tube that is squeezed by means of moving squeeze rollers so as to displace the ink towards the ink reservoir. This type of pump has the advantage that the ink does not come into contact with other materials than the flexible tube, so that the risk of the ink being degraded by reaction with other materials is reduced. However, the flexible tube of such a peristaltic pump tends to be flattened in the course of time, due to reactions with the ink contained therein and/or mechanical fatigue of the flexible tube itself. This flattening of the tube results in a decrease in the flow rate with which the ink can be supplied to the ink reservoir.

It is an object of the invention to provide an ink handling system capable of compensating for a drift in the ink flow rate.

In order to achieve this object, an ink handling system according to the invention is characterized by a pump calibration system comprising:

- an ink consumption measurement system including a droplet counter for counting a number of ink droplets jetted out by the print head assembly and arranged to calculate a volume V of consumed ink on the basis of the counted number of droplets;
- a timer for counting an on-time T of the pump;

- a flow rate calculator arranged to calculate an measured ink flow rate of the pump on the basis of the ratio V/T; and
- a flow rate drift compensation functionality in the pump controller, said compensation functionality being configured to control the operation of the pump on the basis of the measured ink flow rate.

The pump calibration system permits to check the actual flow rate of the pump within short time intervals, i.e. quasi permanently, and to control the pump such that any detected drift in the flow rate is compensated and the flow rate of the pump is re-adjusted to its target value.

As a result, in spite of ageing effects, the pump can be used for a considerably long total operating time and surveillance and maintenance of the pump are greatly facilitated.

More specific optional features of the invention are indicated in the dependent claims.

In one embodiment the pump is driven by a motor and the flow rate drift compensation functionality is configured to control the speed of the motor and thereby to control the fluid displacement by the pump, also termed displacement of the pump.

The ink consumption measurement system may be arranged to measure the ink consumption simply by counting the number of ink droplets that have been jetted out, assuming that each droplet has a known and constant volume. In the simplest case, the number of ink droplets may be counted by counting energizing pulses that are delivered to the individual jetting devices (nozzles) of the print head.

The jetting devices of the print head may be piezoelectric jetting devices having a pressure chamber which contains the ink and is connected to a nozzle, the device further comprising a piezoelectric actuator which may be activated for generating an acoustic pressure wave in the pressure chamber, thereby to expel an ink droplet from the nozzle. As is generally known in the art, such a piezoelectric jetting device may be equipped with a device monitoring system which utilizes the piezoelectric actuator also as a sensor for detecting the acoustic pressure waves that have been created by the actuator itself. This permits to monitor the function of the jetting devices in real time and thereby to assure that an ink droplet has actually been jetting out when an activating pulse has been sent to the actuator. Thus, such a device monitoring system is capable of detecting any possible nozzle failures, so that events of nozzle failure may be taken into account in the counting of droplets.

In a more elaborated embodiment, the device monitoring system may even be used for calculating, on the basis of the detecting pressure waves, the volume of the ink droplet that has been jetting out. When such a device monitoring system is employed, the ink handling system according to the invention is even capable of coping with printers in which the droplet size is variable.

Since the operational state of the pump alternates between an on state and an off state, it is natural to measure the ink consumption and the on-time of the pump over a measurement cycle that consists of a single on-period of the pump and an off-period immediately subsequent thereto. In order to reduce noise effects, it is preferred to average the measurements over a plurality of measurement cycles, using any suitable algorithm for averaging. A particularly useful averaging algorithm is the exponential moving average (EMA) algorithm.

In an embodiment, instead of determining the on-time the number of pump revolutions in an on state is determined. The algorithms described in this application are then adapted accordingly.

The measurement results might possibly be spoiled by certain irregularities that may occur during a measurement cycle. Examples of such irregularities comprise service actions such as flushing or filling or replacing a print head or errors resulting, for example, from a breakdown of a sub-atmospheric pressure that normally prevents the ink from leaking out of the nozzles when the actuators are not energized.

Measurement cycles which are compromised by such irregularities may simply be discarded in the averaging procedure.

Embodiment examples will now be described in conjunction with the drawings, wherein.

Figure 1:
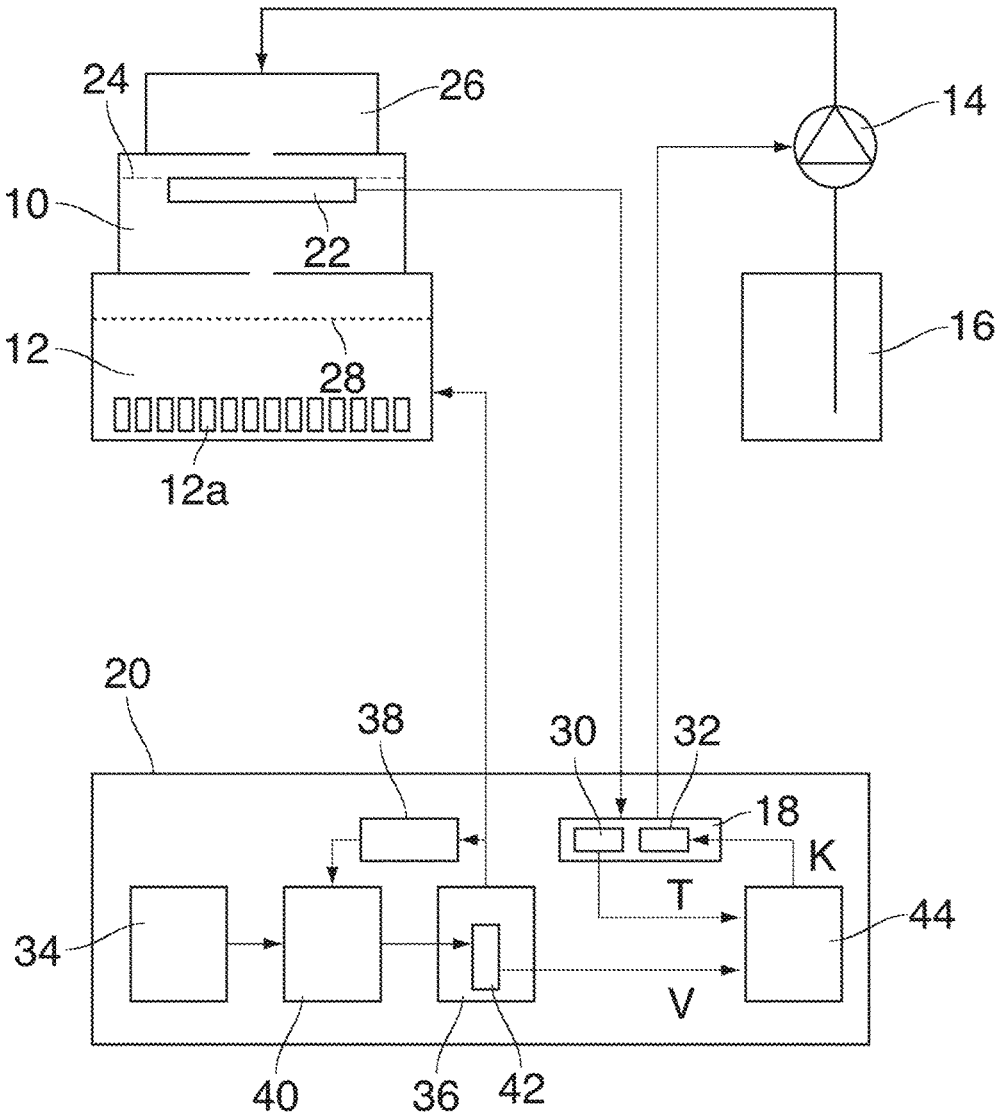
FIG. 1 is a block diagram of an ink jet print head assembly and an ink handling system according to the invention.

As is shown in FIG. 1, an ink handling system comprises a local ink reservoir 10 associated with an ink jet print head assembly 12, and a pump 14 arranged to supply ink from a larger ink storage tank 16 into the ink reservoir 10.

The operation of the pump 14 is controlled by a pump controller 18 that is integrated in a printer controller 20 and receives a detection signal from a fill state detector 22 that detects a level 24 of ink in the ink reservoir 10. In this example, the fill state detector 22 is a single-point detector which detects only whether the level 24 of the ink is above or below a certain threshold. In a modified embodiment the detector may be a two-point detector which delivers a first detection signal when the level 24 is above an upper threshold and delivers a second detection signal when the level 24 is below a lower second threshold.

In this example, the ink handling system further comprises a heater 26 arranged to heat the ink to an elevated operating temperature of the print head assembly 12. When the pump 14 is in an on-state, the ink is pumped from the storage tank 16 to the heater 26 and is heated while it flows through the heater and before it enters into the ink reservoir 10. When ink is consumed in the print head assembly 12, the consumed ink is replaced by ink flowing from the ink reservoir 10 through a filter 28 and into a number of jetting devices 12*a* in the print head assembly 12.

When the pump 14 is in the off-state, the level 24 of ink in the ink reservoir 10 decreases during printing. This decrease is detected by the fill state sensor 22 which delivers a signal to the pump controller 18 which, thereupon, will switch the pump 14 into the on state for a certain time. The print controller 18 includes a timer 30 which counts the on-time of the pump (or alternatively the number of revolutions of the pump in an on state) and switches the pump off when a certain time interval has elapsed (or alternatively after a certain number of revolutions of the pump).

In this embodiment, the pump controller 18 further has a speed controller 32 for controlling the speed of operation of the pump 14.

In an embodiment the timer 30 of the print controller 18 counts the on-time (or revolutions of the pump) and switches off the pump when the fill state sensor 22 produces a signal when the ink level 24 in the ink reservoir 10 has reached a completely filled (i.e. full) state.

The printer controller 20 includes a bit map memory 34 storing image data that define a raster image to be printed with the print head assembly 12. A print head controller 36 controls the individual jetting devices 12*a* of the print head assembly 12 in order to print an image in accordance with the bitmap data by jetting ink droplets from nozzles of the jetting devices onto a recording medium (not shown).

In this example, the printer controller 20 further includes a device monitoring system 38 capable of monitoring the operation of all the jetting devices 12*a* and providing a feedback to a nozzle failure detection and correction system 40. Optionally, the nozzle failure detection and correction system 40 may also have a drop size correction function. The print head controller 36 receives instructions from the nozzle failure detection and correction device 40 so as to compensate for nozzle failures, if possible, and optionally for correcting the drop size of the droplets ejected by the individual ejection devices 12*a*. A droplet counter 42 is implemented in the print head controller 36 for counting the number of droplets that have actually been ejected by all jetting devices 12*a*. Thus, since the volume of the individual droplets is known (or is even feedback-controlled to a known value), the number of droplets counted by the droplet counter 42 is representative of a total volume V of ink that has been consumed in the print head assembly 12.

The timer 30 that is integrated in the pump controller 18 indicates the duration of the on-time of the pump 14. As previously discussed, alternatively the number of revolutions of the pump may be indicated by the pump controller 18 instead of the on-time. Algorithms and controllers are adapted accordingly. Thus, since the pump 14 always replaces the amount of ink that has been consumed by the print head assembly, the flow rate with which the ink flows from the pump 14 into the ink reservoir 10 can be calculated in a flow rate calculator 44 by sampling the volume V and the on-time T over a certain measurement interval and then calculating the ratio V/IT. The measured flow rate of the pump 14 that has been obtained in this way may then be compared to a target flow rate, and if the measured flow rate deviates from the target flow rate, a correction signal K is sent from the flow rate calculator 44 to the speed controller 32 for adjusting the speed of the pump 14 so as to return the actual flow rate of the pump to the target flow rate.

Figure 2:
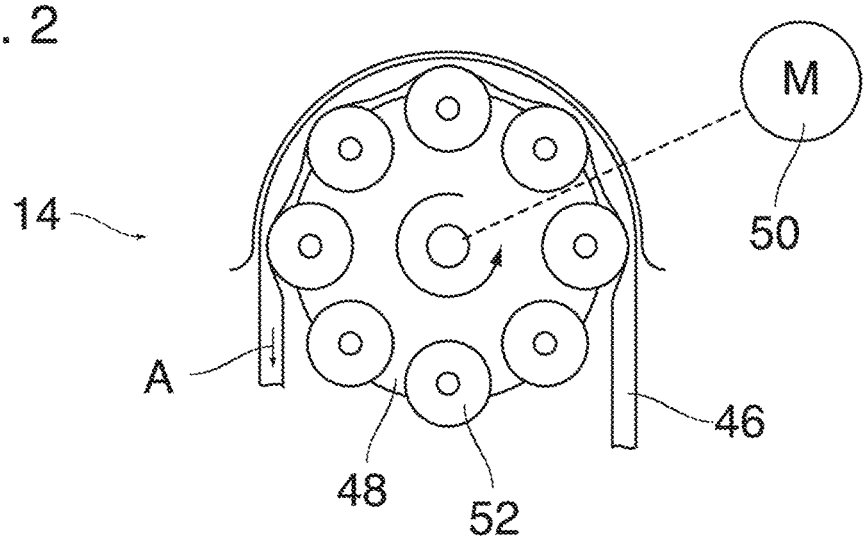
FIG. 2 is a schematic view of a peristaltic pump.

FIG. 2 illustrates an example of the pump 14 which is constituted by a peristaltic pump. In this pump, the ink is contained in a flexible tube 46 that connects the storage container 16 to the heater 26 in FIG. 1 and is guided around the periphery of a wheel 48 driven by a motor 50 so as to rotate at a certain speed. A number of squeeze rollers 52 are disposed on the periphery of the wheel 48 so as to locally squeeze the tube 46. Thus, when the wheel 48 is driven to rotate, in counter-dock sense in the example shown in FIG. 2, the ink in the tube 46 will be displaced in the direction of an arrow A with the certain flow rate which depends upon the speed of rotation of the wheel 48 and upon the internal cross-section of the tube 46.

In the course of time, the elasticity of the tube 46 may decrease, so that the portions of the tube that have been squeezed do no longer return to their original circular cross-sectional shape when they are no longer engaged by a squeeze roller 52, but retain a somewhat flattened shape with reduced cross-section. As a result, the flow rate of the pump 14 will decrease in the course of time. This decrease may however be compensated for by increasing the speed of the motor 50 and consequently, the rotary speed of the wheel 48.

Figure 3:
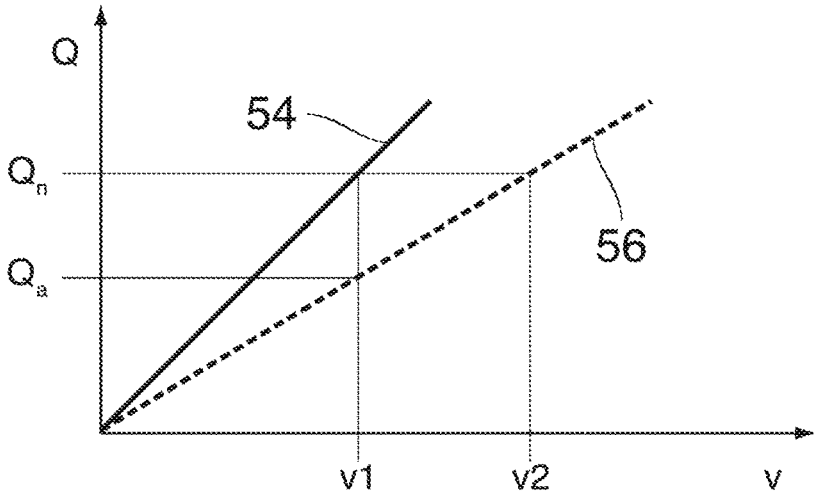
FIG. 3 is a diagram illustrating a relation between an ink flow rate and a speed of revolution of the pump shown in FIG. 2 for different ageing conditions of the pump.

This has been illustrated in FIG. 3 where the flow rate Q of the ink, as displaced by the pump 14, has been shown as a function of the rotary speed v of the pump. The curve 54 in FIG. 3 illustrates the linear relation between the flow rate Q and the speed v for the case that the tube 46 has not been subject to ageing, whereas the curve 56 illustrates the case that the tube 46 has become flattened to some extent. It can be seen that the resulting decrease in the flow rate Q can be compensated by increasing the speed from the original value v1 to a somewhat higher value v2. If $Q_n$ is the nominal flow rate (target flow rate) of the pump, obtained when the non-aged pump rotates with speed v1, and $Q_a$ is the flow rate that is actually measured for the present state of the pump, then the flow rate can be returned from $Q_a$ to $Q_n$ by multiplying the nominal speed v1 of the pump with a correction factor $K=Q_n/Q_a$, i.e.:

$$v2=K/*v1$$

In the example shown in FIG. 1, the correction signal applied to the speed controller 32 is the correction factor K as defined above.

Figure 4:
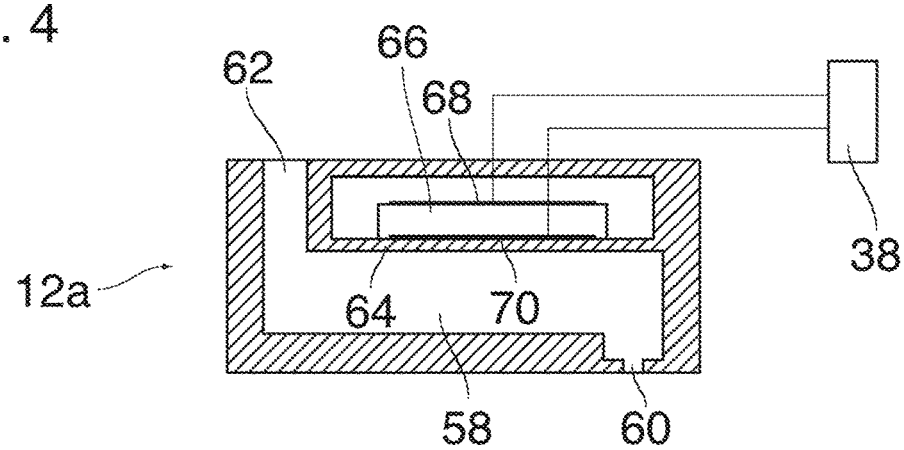
FIG. 4 is a schematic cross-sectional view of a single jetting device in the print head assembly.

FIG. 4 is a schematic view of an individual jetting device 12*a*. This jetting device has a pressure chamber 58 having one end connected to a nozzle 60 and another end connected to the ink reservoir 10 by an ink supply passage 62. One wall of the pressure chamber 58 is constituted by a flexible membrane 64 to which a piezoelectric actuator 66 has been attached. When an electric voltage is applied to electrodes 68, 70 of the actuator 66, the actuator causes the membrane 64 to flex into the pressure chamber 58, thereby creating an acoustic pressure wave in the ink in the pressure chamber. The pressure wave propagates to the nozzle 60, with the result that an ink droplet is expelled from the nozzle.

The electrodes 68, 70 are not only connected to a voltage source in the print head controller 36 (not shown in FIG. 4) but also to the device monitoring system 38. This permits the device monitoring system 38 to detect voltages that are induced in the piezoelectric actuator 66 when the acoustic pressure wave that has been exited by the actuator oscillates and decays in the pressure chamber 58 and, in turn, causes a deflection of the actuator. By analyzing these induced voltages the device monitoring system 38 can detect whether a droplet has actually been expelled from the nozzle or whether the nozzle is clogged, for example. The characteristic voltage signal obtained from the actuator 66 may also be analyzed for estimating the size of the droplet that has been ejected. When the droplet size deviates from a given target value, the measured droplet size may be fed-back to the print head controller 36 which will thereupon modify the voltages applied to the actuator so as to return the droplet size to the target value. This is one of the tasks of the nozzle failure detection and correction system 40 in FIG. 1. Another task of this system is to detect nozzle failures, i.e. instances in which it can be inferred from the feedback signal from the device monitoring system 38 that no droplet has been ejected in response to an energizing pulse.

When such a nozzle failure has been detected, the droplet counter 42 will not increment its count because no droplet has actually been ejected. In this way, the volume V can be measured exactly in spite of the occurrence of nozzle failures.

Under certain conditions, e.g. when the print head assembly 12 operates in a multi-pass mode, it is possible however to compensate for a nozzle failure by activating another jetting device 12*a* at or close to the pixel position of the failing nozzle. In that case, the extra droplet produced by this jetting device will of course be counted.

Figure 5:
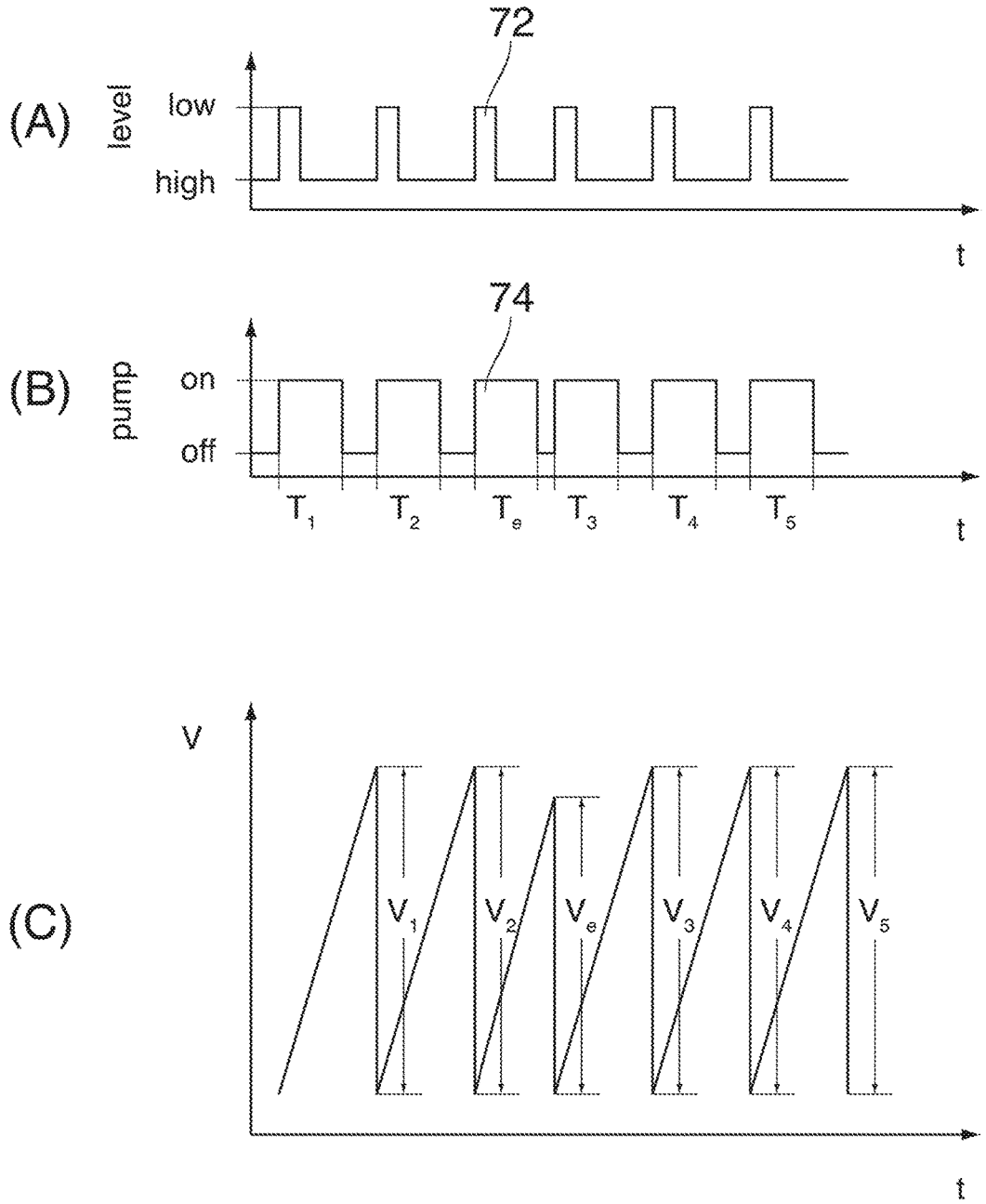
FIG. 5 is a set of diagrams illustrating a sequence of measurement cycles in the ink handling system shown in FIG. 1.

A number of measuring cycles for sampling the on-time T and the volume V has been illustrated in FIG. 5.

The diagram (A) in FIG. 5 illustrates a detection signal 72 obtained from the fill state sensor 22. It is assumed here that the fill state sensor generates a pulse whenever the level 24 of the ink decreases below the position of the sensor 52, indicating that the ink level is "low".

The diagram (B) in FIG. 5 illustrates an on/off signal 74 for controlling the pump 14. Each pulse of the detection signal 72 causes the pump controller 18 to switch the pump to the state "on". In this example, the pump is switched into the off-state again when the timer 30 detects that a certain pre-set time interval $T_1$, $T_2$, . . . has elapsed (The times $T_1$, $T_2$, etc are all equal in this example). In a modified embodiment the pump would be switched back into the off-state when the fill state sensor 22 detects that the level 24 of the ink has increased above a higher threshold level. In that case the timer 30 would have the function to count the lengths of the on-times.

The diagram (C) in FIG. 5 illustrates the volume V of consumed ink as determined by the droplet counter 42. This counter is reset whenever a pulse occurs in the signal 72 of the fill state sensor 22. At this instant the droplet counter 42 starts to count the droplets expelled by all jetting devices 12*a*, and the counter continues counting even when the pump is switched off again, because ink continues to be consumed regardless of the on/off state of the pump. The count value that is reached at the instance when the next pulse in the signal 72 occurs indicates the total volume $V_1$, $V_2$, . . . of the ink that has been consumed in the time interval between the two pulses in the signal 72. Then, a flow rate of the pump 14 can be calculated for each measurement cycle by calculating the quotients $V_1/T_1$, $V_2/T_2$, . . . . In the given example, it can be seen in the diagram (C) in FIG. 5 that a time $T_e$ between the third and the fourth pulse in the signal 72 is smaller than the other time intervals, and volume $V_e$ determined by the droplet counter 42 at the time of occurrence of the fourth pulse in the signal 72 is smaller than the others. The reason is that, as assumed in this example, some kind of irregularity has occurred in the measurement cycle between the third and the fourth pulse, and this irregularity has led to a loss of some ink from the ink reservoir 10 which is not due to the intended ejection of ink droplets from the nozzles but is due to leakage, for example. Such an irregular loss would of course compromise the measurement of the flow rate, and therefore the results obtained in such irregular measurement cycles are discarded and not evaluated further. This is why, in FIG. 5, the on-time obtained in the fourth measurement cycle is designated as $T_3$ (rather than $T_4$) and the corresponding volume is designated as $V_3$.

Alternatively, the droplet counter 42 is reset whenever the pump is set to an off state, hence counting the number of droplets and determining the used ink volume V until the start of the subsequent fill dosage. In this alternative embodiment, the used ink volume V and the subsequent fill dosage are directly correlated. Algorithms and controllers are adapted accordingly (not shown).

Figure 6:
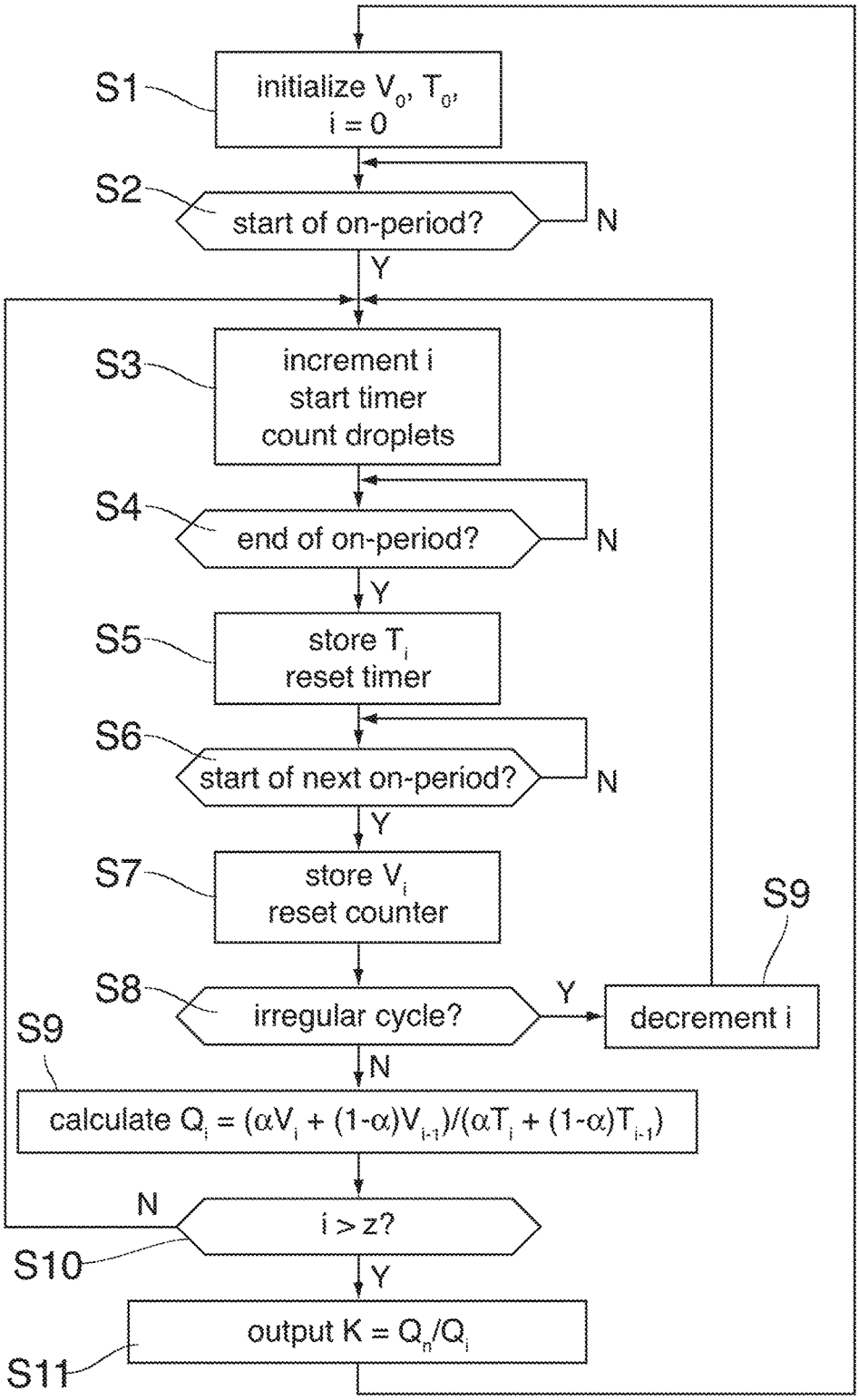
FIG. 6 is a flow diagram showing an example of a mode of operation of a pump calibration system.

FIG. 6 is a flow diagram illustrating a process of calibrating the pump 14 so as to compensate for a drift in the flow rate in the ink handling system described above.

In step S1, a volume variable $V_0$ and a time variable $T_0$ are initialized, i.e. are set to certain pre-defined values, as will be explained later. Further, in this step, a cycle count i is reset to zero.

Then it is checked in step S2 whether an on-period of the pump 14 has started (triggered by a pulse from the fill state sensor 22). If this is not the case (N), the step S2 is repeated until the start of an on-period is detected (Y).

Then, in step S3, the cycle count i is incremented by one, the timer 30 is started, and the droplet counter 42 starts counting droplets.

In step S4, it is checked whether the on-period has ended (pump 14 switched back to the off-state). As long as this is not the case (N), the step S4 is repeated.

When the on-period has ended (Y), the on-time Ti for the present (i-th) measurement cycle, as determined by the timer 30, is stored in a memory, and the timer 30 is reset (step S5).

Then it is checked in step S6 whether a next on-period has started. If this is not the case (N), the step S6 is repeated.

As soon as the next on-period has started (Y), the volume Vi counted by the droplet counter 42 for the present (i-th) measurement cycle is stored in a memory, and the counter is reset (step S7).

Then it is checked in step S8 whether any irregularities have occurred in the measurement cycle that has just been completed. Some of these irregularities may be detected by checking whether certain maintenance operations have been performed on purpose, e.g. flushing a print head or replacing a print head (which would lead to an irregular loss of ink) or filling a print head with extra ink (which would lead to an irregular increase in the amount of ink). Another example of such irregularities would be a situation in which one or more of the piezoelectric actuators are energized with maintenance pulses which are only to agitate the ink in the pressure chamber but do not lead to a droplet being jetting out. If the device monitoring system 38 cannot reliably decide whether or not a droplet has been ejected in such cases, an error in the measurement must be expected and the measurement cycle would be considered as irregular.

An irregularity may also be inferred from the fact that the time interval between two successive pulses from the fill state sensor 22 is unusually small (as for the interval between the third and fourth pulses in FIG. 5(A).

If an irregularity is found in step S8 (Y), the cycle count i is decremented by one in step S9, and the process loops back to step S3 where the cycle count is incremented again so that it has the same value as before. As a result, the values $T_i$ and $V_i$ that had previously been stored in steps S5 and S7 will be overwritten with the results obtained in the new measurement circle, which means that the previous cycle in which the irregularity has occurred is discarded.

If no irregularity has been found in step S8 (N), the values $V_i$ and $T_i$ obtained in the preceding measurement cycles are averaged in step S9 for calculating a flow rate estimate on the basis of the averaged values.

In this example, step S9 consists of calculating a flow rate $Q_i$ on the basis of an exponential moving average EMA in accordance with the following formula:

$$Q_i=(\alpha V_i+(1-\alpha)V_{i-1})/(\alpha T_i+(1-\alpha)T_{i-1}).$$

The parameter $\alpha$ defines a time constant $1/\alpha$ which describes how fast the calculated flow rate $Q_i$ adapts to sudden changes in the actual flow rate of the pump. Suitable values may be for example $\alpha=1/50$ or $\alpha=1/100$.

For i=1, the values $V_{i-1}$ and $T_{i-1}$ will be the values $V_0$ and $T_0$ as initialized in step S1. These values $V_0$ and $T_0$ should be realistic estimates which assure that the EMA converges quickly to the actual flow rate.

The EMA algorithm has the advantage that the average can adapt to the actual flow rate with a short time constant, and it is not necessary to store the entire history of measurements made in the previous cycles.

In step S10 it is checked whether the cycle count i exceeds a pre-set limit z, which is an integral number in the order of magnitude of $1/\alpha$ or $\frac{1}{2}\alpha$. The limit z is selected such that noise in the measurement results is reasonably suppressed and, on the other hand, the number of measurement cycles required for eventually obtaining a measured flow rate does not become too long.

If the limit z has not yet been reached (N), then the steps S3-S10 are repeated in a loop.

As soon as the limit z has been reached (Y), the loop is exited with step S11 where the correction factor $K=Q_n/Q_i$ is output to the speed controller 32 (the $Q_i$ obtained in the last measurement cycle i before exciting the loop is taken as an estimate for the measured (actual) flow rate $Q_a$). Thus, if it is found for example that $Q_i$ is smaller than $Q_n$ then the speed of the pump 14 will be increased so as to return the actual flow rate to the target value $Q_n$.

Thereafter, the procedure shown in FIG. 6 may start again with step S1, so that the flow rate will be updated again after another z measurement cycles.

In the example shown here, the on-times $T_1$, $T_2$, . . . are all determined by the timer 30 and have all the same known value. Thus, $T_0$ will also be set to this value in step S1. Similarly, since the calibration of the pump as achieved in step S11 can be expected to have the effect that the flow rate corresponds again to the nominal flow rate $Q_n$, it is reasonable to set $V_0$ to $Q_n*T_0$.

The invention claimed is:

1. An ink handling system for an ink jet printer, the ink handling system comprising:

- a local ink reservoir associated with a print head assembly of the printer;
- a fill state sensor arranged to detect a fill state of the local ink reservoir;
- a pump driven by a motor arranged to supply ink into the local ink reservoir;
- a pump controller for controlling an operation of the pump, including controlling an on/off state of the pump, on the basis of a detection result of the fill state sensor; and
- a pump calibration system, the pump calibration system comprising:
  - an ink consumption measurement system including a droplet counter for counting a number of ink droplets jetted out by the print head assembly and arranged to calculate a volume V of consumed ink on the basis of the counted number of droplets;
  - a timer for counting an on-time T of the pump;
  - a flow rate calculator arranged to calculate a measured ink flow rate ($Q_i$) of the pump on the basis of the ratio V/T; and
  - a flow rate drift compensation functionality in the pump controller comprising a speed controller controlling the speed of the motor, said flow rate drift compensation functionality being configured to control the operation of the pump on the basis of the measured ink flow rate ($Q_i$) such that any detected drift in the flow rate is compensated by the speed controller by controlling the speed of the motor.

2. The ink handling system according to claim 1, wherein the pump is a peristaltic pump.

3. The ink handling system according to claim 1, wherein the flow rate calculator is configured to sample values of the volume V of the consumed ink over a plurality of measurement cycles and to average these values for calculating the measured flow rate ($Q_i$), the measurement cycles being synchronized with cycles of switching the pump from the off-state to the on-state.

4. The ink handling system according to claim 3, wherein the flow rate calculator is configured to discard, before averaging, results from measurement cycles for which there are indicia that the results may be compromised.

5. The ink handling system according to claim 3, wherein the flow rate calculator is configured to calculate the measured flow rate (Qi) on the basis of an average of values ($V_i$) sampled from a plurality of measurement cycles and on the basis of an average of on-times $T_i$ sampled over the same measurement cycles.

6. The ink handling system according to claim 5, wherein the flow rate calculator is configured to calculate an exponential moving average (EMA).

7. The ink handling system according to claim 3, wherein the flow rate calculator and the pump controller are configured to adapt control settings for the pump in intervals corresponding to a plurality of measurement cycles.

* * * * *